US006840142B2

(12) United States Patent
Cheng

(10) Patent No.: US 6,840,142 B2
(45) Date of Patent: Jan. 11, 2005

(54) SOCKET WRENCH EXTENSION

(76) Inventor: Chin-Shun Cheng, No.4, Lane 326, Peng-I Road, Tai-Ping, Taichung Hsien (TW)

( * ) Notice: Subject to any disclaimer, the term of this patent is extended or adjusted under 35 U.S.C. 154(b) by 0 days.

(21) Appl. No.: 10/291,501

(22) Filed: Nov. 12, 2002

(65) Prior Publication Data

US 2004/0089116 A1 May 13, 2004

(51) Int. Cl.[7] ..... B25B 23/16

(52) U.S. Cl. ..... 81/177.85; 403/322.2; 403/322.3; 279/81

(58) Field of Search ..... 81/177.85, 177.2, 81/900; 403/322.2, 322, 322.3; 279/71, 81

(56) References Cited

U.S. PATENT DOCUMENTS 2,718,806 A * 9/1955 Clark ..... 81/177.85
5,531,140 A * 7/1996 Chow ..... 81/177.85
6,209,208 B1 * 4/2001 Marinkovich et al. ..... 279/71
6,523,441 B2 * 2/2003 Lee ..... 81/177.85

* cited by examiner

*Primary Examiner*—Debra S. Meislin
(74) *Attorney, Agent, or Firm*—Alan D. Kamrath; Nikolai & Mersereau, P.A.

(57) ABSTRACT

A socket wrench extension includes an elongated rod, a drive rod, a steel ball, a control knob, an elastic member, and a magnetic member. The screw member is inserted into the socket, and is attracted by the magnetic force of the magnetic member that is secured on the drive rod, so that the screw member is secured on the drive rod and is not detached from the socket, thereby facilitating the user using the elongated rod and the socket to operate the screw member. In addition, when the control knob is pressed, the drive rod and the magnetic member are fully retracted into the receiving chamber of the elongated rod, so that the screw member is detached from the magnetic member automatically.

1 Claim, 10 Drawing Sheets

SOCKET WRENCH EXTENSION

BACKGROUND OF THE INVENTION

1. Field of the Invention

The present invention relates to a socket wrench extension, and more particularly to a socket wrench extension, wherein the socket is mounted on and detached from the drive rod easily and conveniently, and the screw member is mounted on and detached from the magnetic member easily and conveniently.

2. Description of the Related Art

A conventional socket wrench extension in accordance with the prior art shown in FIG. 1 comprises an elongated rod 30A, a drive rod 40A, a steel ball 60A, a control knob 50A, and an elastic member 70A.

The elongated rod 30A has one end formed with a receiving chamber 31A and a first locking hole 32A and a second locking hole 33A each communicating with the receiving chamber 31A. The drive rod 40A is slidably mounted in the receiving chamber 31A of the elongated rod 30A, and has a first end formed with a first retaining cavity 41A communicating with the first locking hole 32A of the elongated rod 30A and a second end formed with a second retaining cavity 42A communicating with the second locking hole 33A of the elongated rod 30A. The steel ball 60A is mounted in the first retaining cavity 41A of the drive rod 40A, and is partially protruded outward from the first locking hole 32A of the elongated rod 30A. The control knob 50A is mounted in the second retaining cavity 42A of the drive rod 40A, and is partially protruded outward from the second locking hole 33A of the elongated rod 30A. The elastic member 70A is mounted in the receiving chamber 31A of the elongated rod 30A, and is urged between the second end of the drive rod 40A and the receiving chamber 31A of the elongated rod 30A.

SUMMARY OF THE INVENTION

The primary objective of the present invention is to provide a socket wrench extension, wherein the socket is mounted on and detached from the drive rod easily and conveniently, and the screw member is mounted on and detached from the magnetic member easily and conveniently.

Another objective of the present invention is to provide a socket wrench extension, wherein the screw member is inserted into the socket, and is attracted by the magnetic force of the magnetic member that is secured on the first end of the drive rod, so that the screw member is secured on the drive rod and is not detached from the socket, thereby facilitating the user using the elongated rod and the socket to operate the screw member.

A further objective of the present invention is to provide a socket wrench extension, wherein when the control knob is pressed, the drive rod and the magnetic member are fully retracted into the receiving chamber of the elongated rod, so that the screw member is detached from the magnetic member automatically.

In accordance with the present invention, there is provided a socket wrench extension, comprising:

an elongated rod, having one end having an inner wall formed with a circular receiving chamber and having a periphery formed with a first locking hole and a second locking hole each communicating with the receiving chamber;

a drive rod, slidably mounted in the receiving chamber of the elongated rod, and having a first end formed with an oblique first retaining cavity communicating with the first locking hole of the elongated rod and an oblique second end formed with a second retaining cavity communicating with the second locking hole of the elongated rod;

a steel ball, mounted in the first retaining cavity of the drive rod, and partially protruded outward from the first locking hole of the elongated rod;

a control knob, mounted in the second retaining cavity of the drive rod, and partially protruded outward from the second locking hole of the elongated rod;

an elastic member, mounted in the receiving chamber of the elongated rod, and having a first end urged on the second end of the drive rod and a second end urged on the wall of the receiving chamber of the elongated rod; and a magnetic member, secured on the first end of the drive rod.

Further benefits and advantages of the present invention will become apparent after a careful reading of the detailed description with appropriate reference to the accompanying drawings.

DETAILED DESCRIPTION OF THE INVENTION

Figure 1:
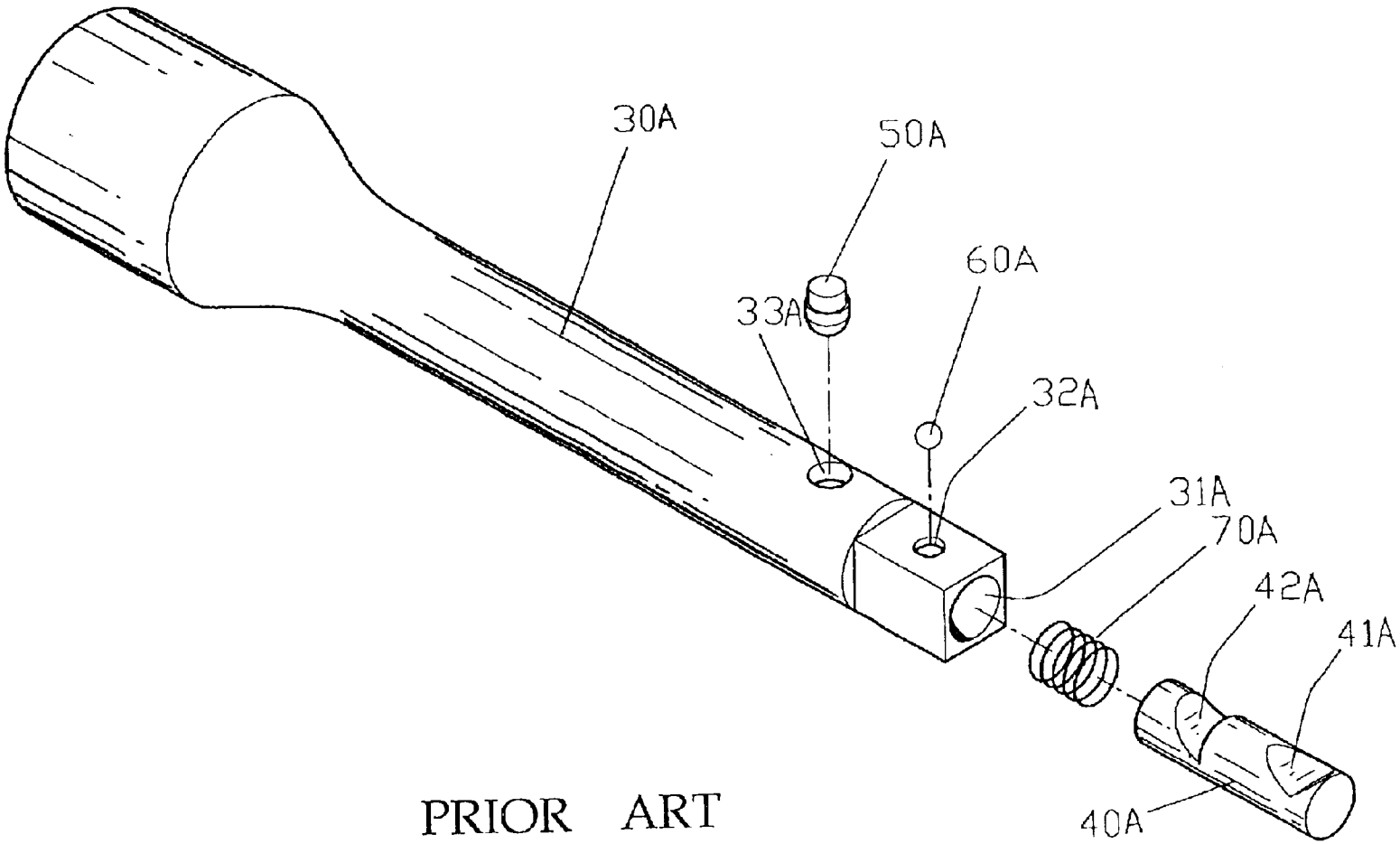
PRIOR ART FIG.1
FIG. 1 is an exploded perspective view of a conventional socket wrench extension in accordance with the prior art.
Figure 2:
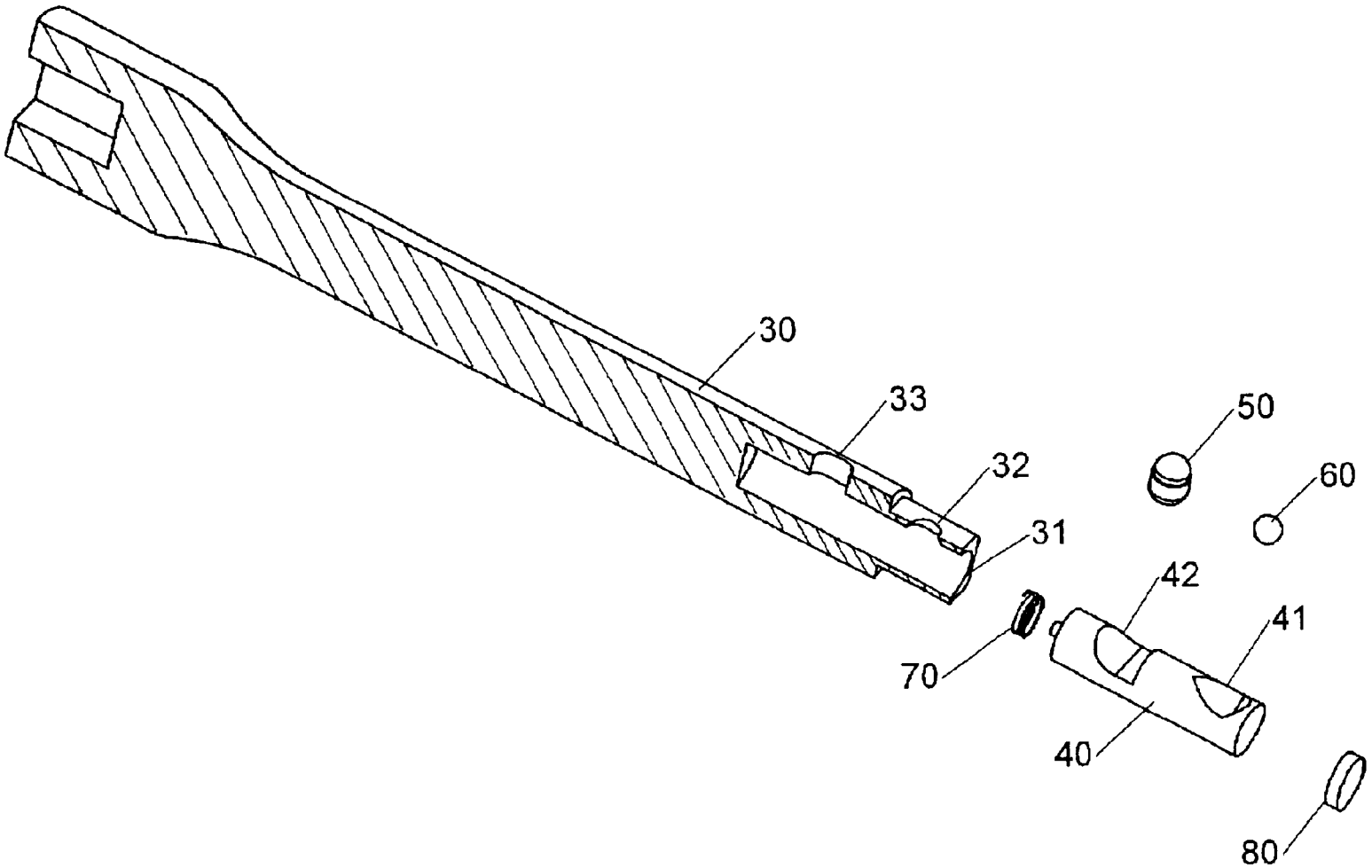
FIG. 2 is an exploded perspective view of a socket wrench extension in accordance with a first embodiment of the present invention.
Figure 3:
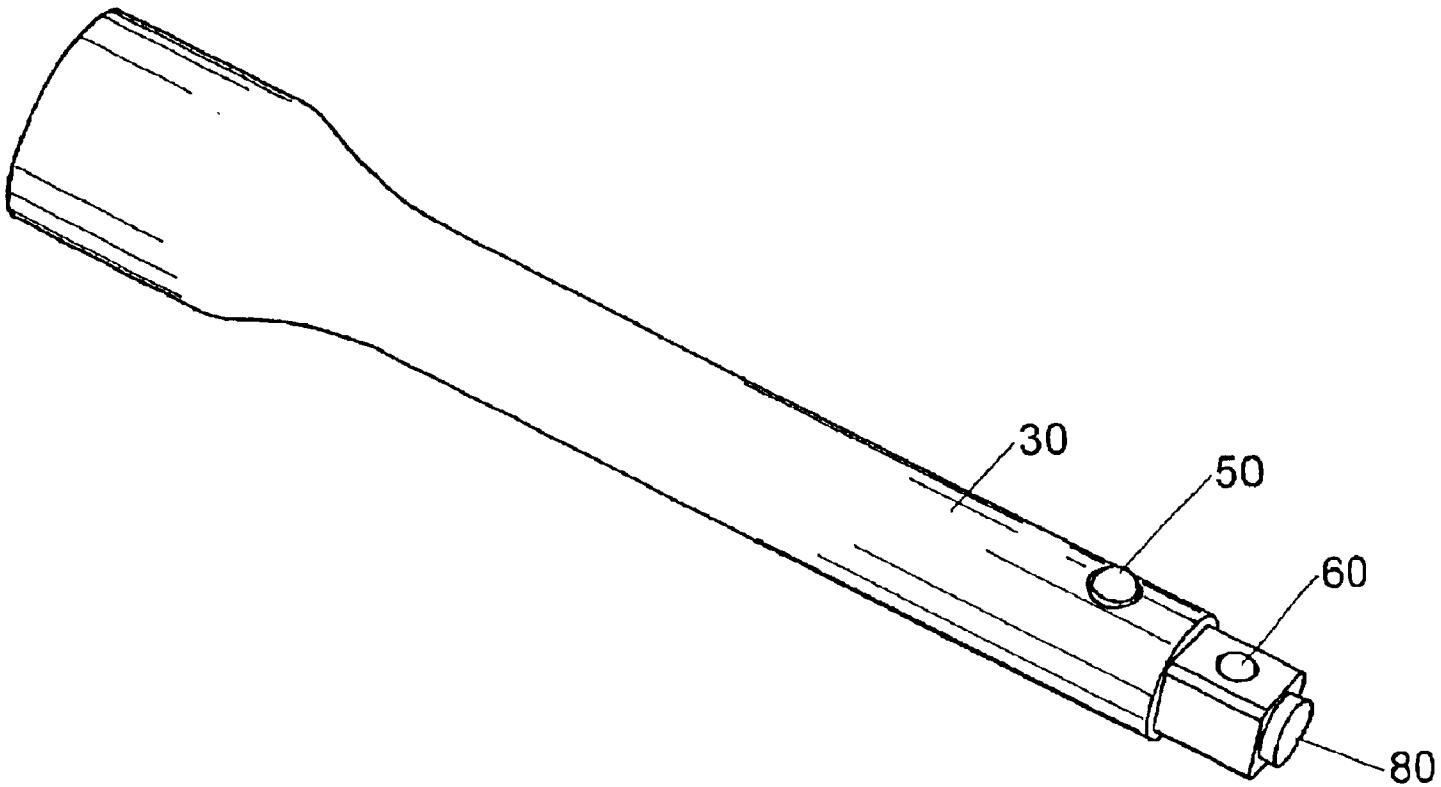
FIG. 3 is a perspective assembly view of the socket wrench extension in accordance with the first embodiment of the present invention.
Figure 4:
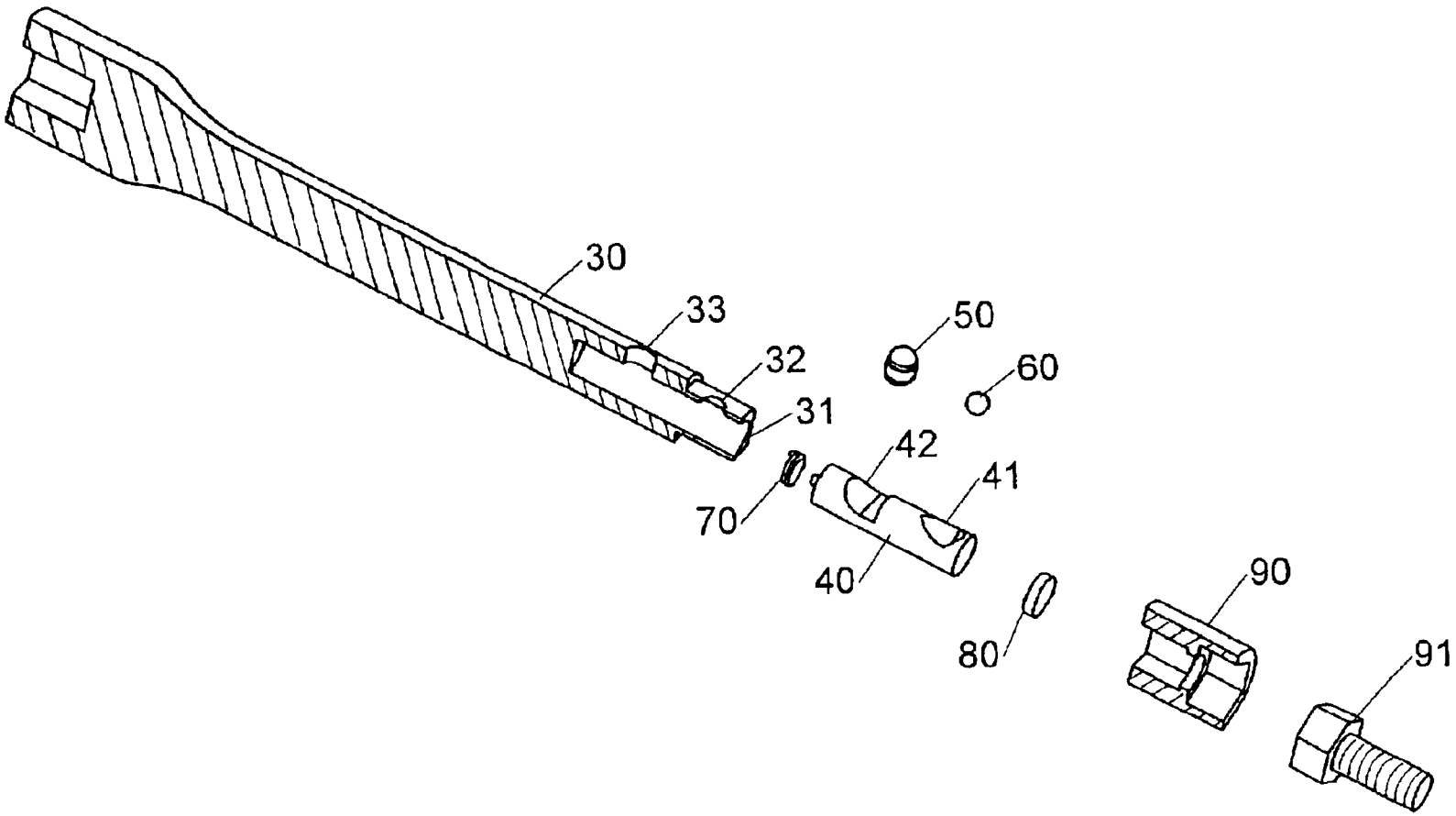
FIG. 4 is an exploded perspective view of the socket wrench extension in accordance with the first embodiment of the present invention.

Referring to the drawings and initially to FIGS. 2 and 3, a socket wrench extension in accordance with a first embodiment of the present invention comprises an elongated rod 30, a drive rod 40, a steel ball 60, a control knob 50, an elastic member 70, and a magnetic member 80.

The elongated rod 30 has one end having an inner wall formed with a circular receiving chamber 31 and having a periphery formed with a first locking hole 32 and a second locking hole 33 each communicating with the receiving chamber 31.

The drive rod 40 is slidably mounted in the receiving chamber 31 of the elongated rod 30, and has a first end formed with an oblique first retaining cavity 41 communicating with the first locking hole 32 of the elongated rod 30 and an oblique second end formed with a second retaining cavity 42 communicating with the second locking hole 33 of the elongated rod 30.

The steel ball 60 is mounted in the first retaining cavity 41 of the drive rod 40, and is partially protruded outward from the first locking hole 32 of the elongated rod 30.

The control knob 50 is mounted in the second retaining cavity 42 of the drive rod 40, and is partially protruded outward from the second locking hole 33 of the elongated rod 30.

The elastic member 70 is mounted in the receiving chamber 31 of the elongated rod 30, and has a first end urged on the second end of the drive rod 40 and a second end urged on the wall of the receiving chamber 31 of the elongated rod 30.

The magnetic member 80 is secured on the first end of the drive rod 40.

Figure 5:
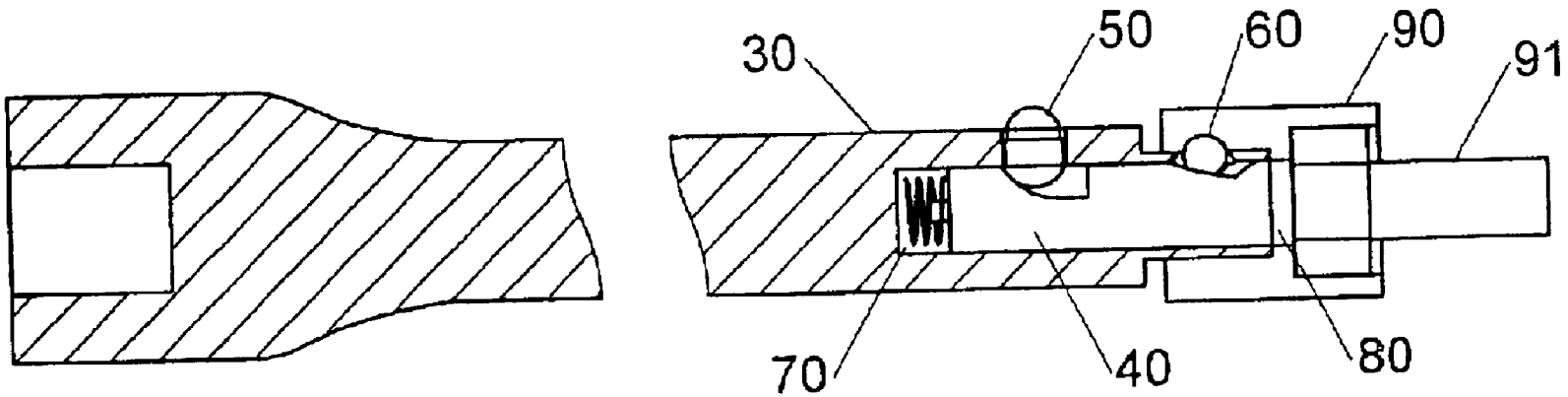
FIG. 5 is a front plan partially cut-away cross-sectional assembly view of the socket wrench extension as shown in FIG. 4.

Referring to FIGS. 2–5, the socket 90 is secured on the drive rod 40 by the steel ball 60 which is received in the shallower portion of the first retaining cavity 41 of the drive rod 40 and is partially protruded outward from the first locking hole 32 of the elongated rod 30 as shown in FIG. 5. Then, the screw member 91 is inserted into the socket 90, and is attracted by the magnetic force of the magnetic member 80, thereby facilitating the user using the elongated rod 30 and the socket 90 to operate the screw member 91.

Figure 6:
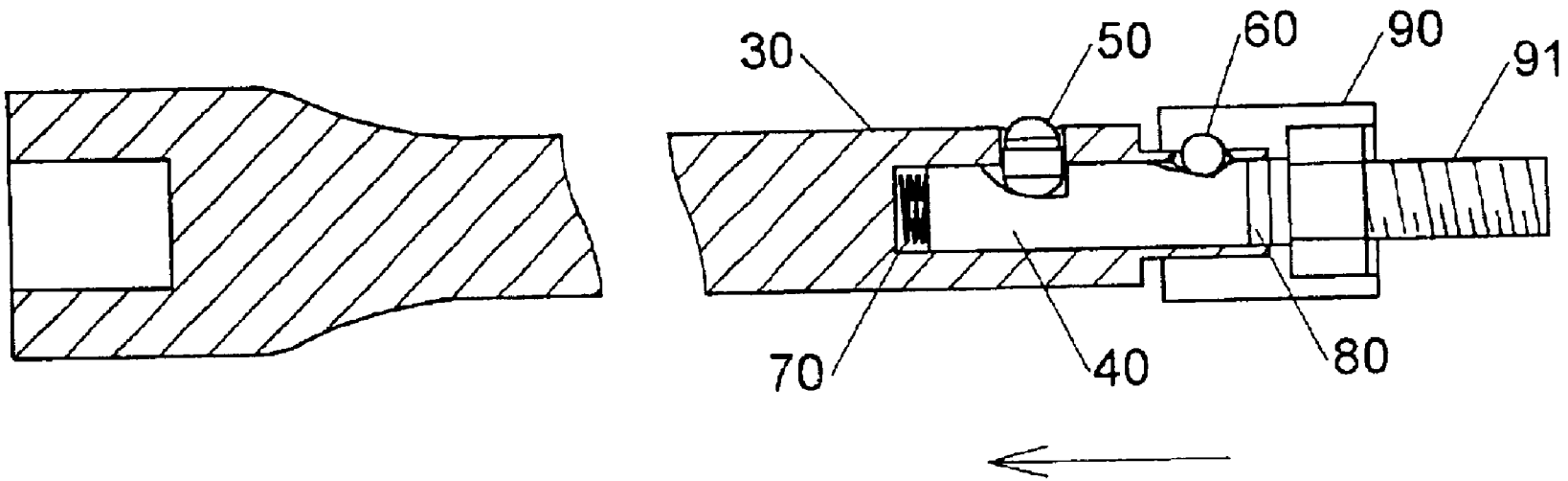
FIG. 6 is a schematic operational view of the socket wrench extension as shown in FIG. 5 in use.

Referring to FIGS. 2–6, the control knob 50 is pressed to retract into the second locking hole 33 of the elongated rod 30 so as to press the wall of the second retaining cavity 42 of the drive rod 40. At this time, the second retaining cavity 42 of the drive rod 40 has an oblique depth. Thus, when the control knob 50 presses the wall of the second retaining cavity 42 of the drive rod 40, the drive rod 40 is pushed to move into the receiving chamber 31 of the elongated rod 30 to compress the elastic member 70, and the steel ball 60 is moved into the deeper portion of the first retaining cavity 41 of the drive rod 40 as shown in FIG. 6, so that the steel ball 60 is entirely retracted into the first locking hole 32 of the elongated rod 30. Thus, the steel ball 60 is detached from the socket 90, so that the socket 90 is detached from the drive rod 40 easily and conveniently. In addition, the screw member 91 is detached from the magnetic member 80.

Figure 7:
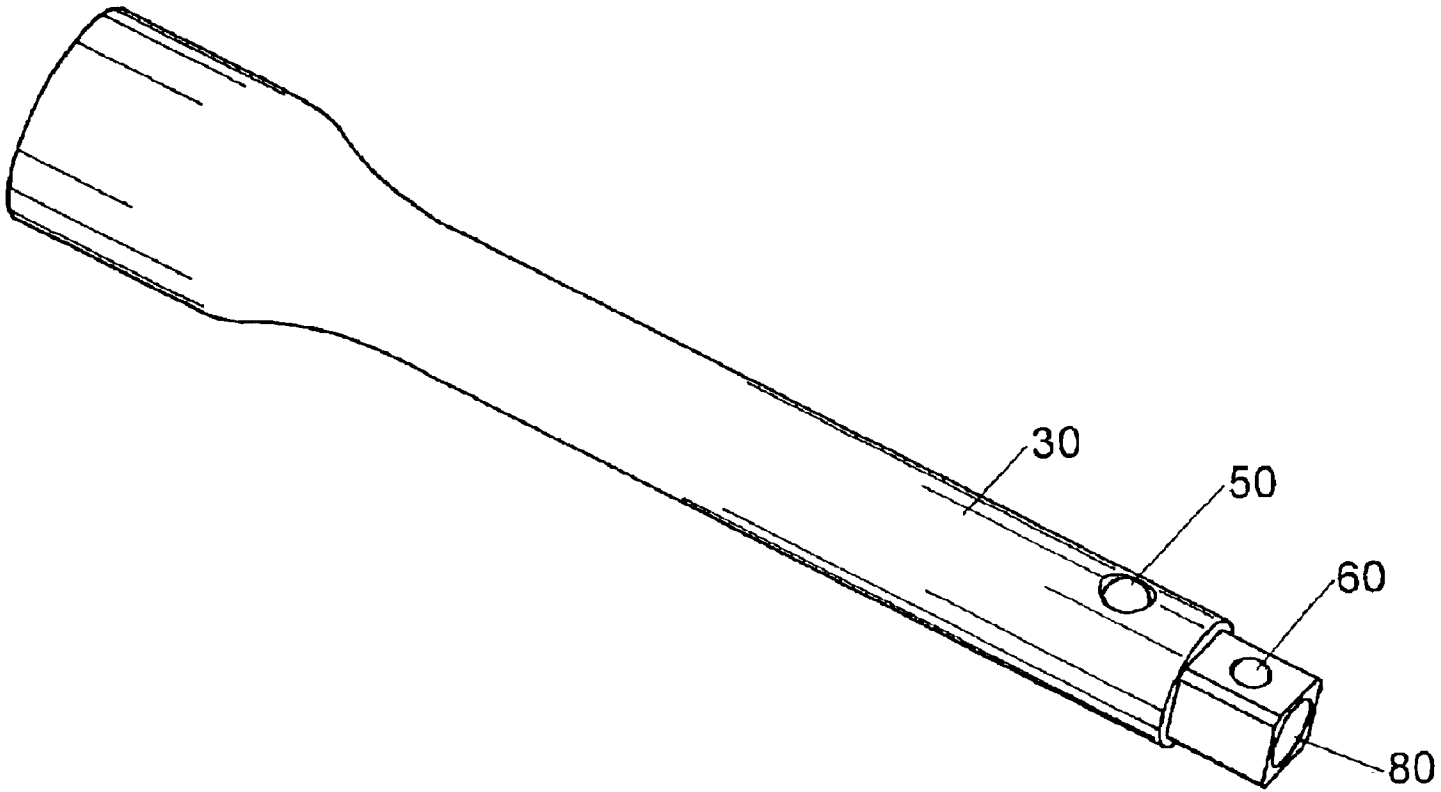
FIG. 7 is a perspective assembly operational view of the socket wrench extension as shown in FIG. 2 in use.

As shown in FIG. 7, the drive rod 40 and the magnetic member 80 are fully retracted into the receiving chamber 31 of the elongated rod 30.

Figure 8:
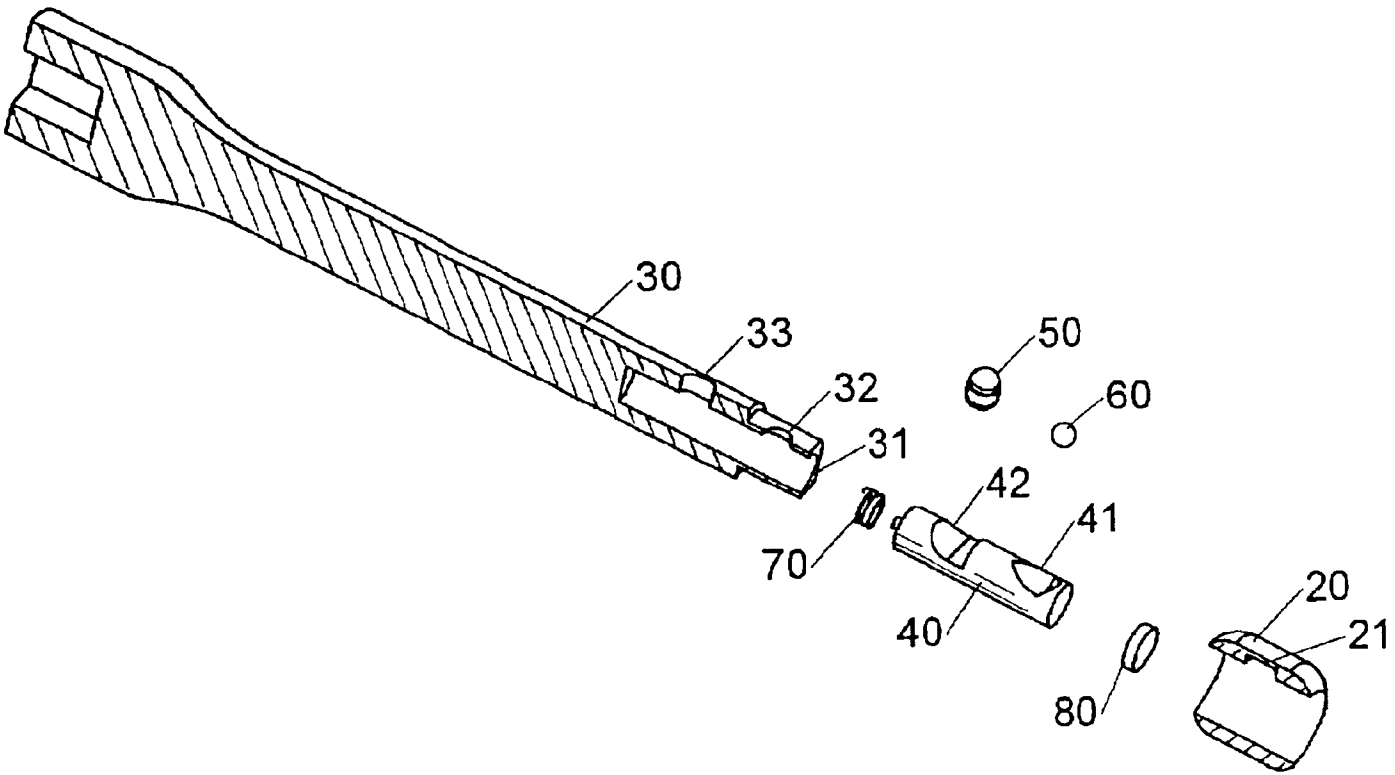
FIG. 8 is an exploded perspective view of a socket wrench extension in accordance with a second embodiment of the present invention.
Figure 9:
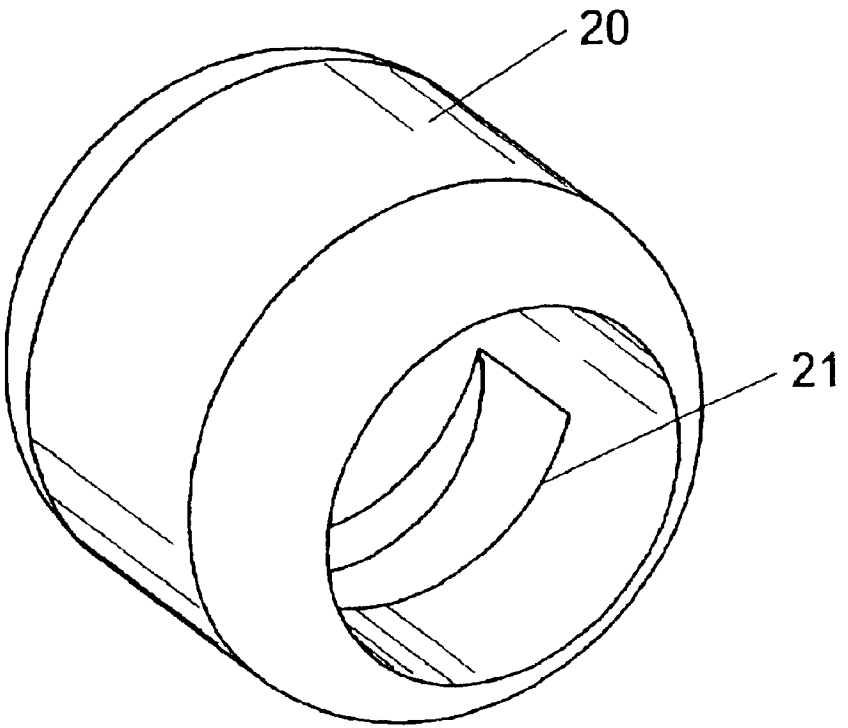
FIG. 9 is an enlarged perspective view of a control ring of the socket wrench extension in accordance with the second embodiment of the present invention.
Figure 10:
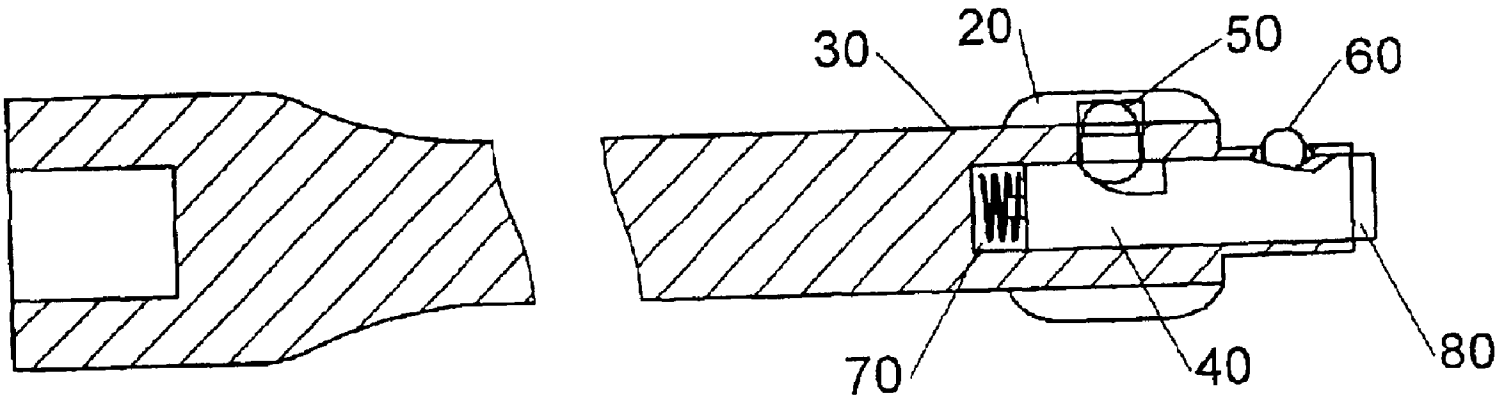
FIG. 10 is a front plan partially cut-away cross-sectional assembly view of the socket wrench extension as shown in FIG. 8.

Referring to FIGS. 8–10, a socket wrench extension in accordance with a second embodiment of the present invention further comprises a control ring 20 mounted on the outer wall of the elongated rod 30. The control ring 20 has an inner wall formed with an arcuate guide groove 21 aligning with the second locking hole 33 of the elongated rod 30 for receiving the control knob 50. The wall of the arcuate guide groove 21 of the control ring 20 is urged on the control knob 50.

In assembly, the control ring 20 mounted on the outer wall of the elongated rod 30 to press the control knob 50 into the second locking hole 33 of the elongated rod 30. After the control knob 50 aligns with the arcuate guide groove 21 of the control ring 20, the control knob 50 is bounced and is inserted into the arcuate guide groove 21 of the control ring 20, thereby forming a locking effect, so that the control ring 20 is positioned on the elongated rod 30, and the control knob 50 is retained by the control ring 20.

In operation, when the control ring 20 is rotated, the wall of the arcuate guide groove 21 of the control ring 20 is moved to press the control knob 50 as shown in FIG. 10, so that the control knob 50 is pressed to retract into the second locking hole 33 of the elongated rod 30 so as to press the wall of the second retaining cavity 42 of the drive rod 40. At this time, the second retaining cavity 42 of the drive rod 40 has an oblique depth. Thus, when the control knob 50 presses the wall of the second retaining cavity 42 of the drive rod 40, the drive rod 40 is pushed to move into the receiving chamber 31 of the elongated rod 30 to compress the elastic member 70, and the steel ball 60 is moved into the deeper portion of the first retaining cavity 41 of the drive rod 40, so that the steel ball 60 is entirely retracted into the first locking hole 32 of the elongated rod 30.

When the control ring 20 is released, the drive rod 40 is pulled to move outward from the receiving chamber 31 of the elongated rod 30 by the restoring force of the elastic member 70, so that the control knob 50 is pressed by the wall of the second retaining cavity 42 of the drive rod 40 to move outward to press the wall of the arcuate guide groove 21 of the control ring 20, thereby rotating and returning the control ring 20 to its original position.

Accordingly, the socket wrench extension in accordance with the present invention has the following advantages.

The screw member 91 is inserted into the socket 90, and is attracted by the magnetic force of the magnetic member 80 that is secured on the first end of the drive rod 40, so that the screw member 91 is secured on the drive rod 40 and is not detached from the socket 90, thereby facilitating the user using the elongated rod 30 and the socket 90 to operate the screw member 91. In addition, when the control knob 50 is pressed, the drive rod 40 and the magnetic member 80 are fully retracted into the receiving chamber 31 of the elongated rod 30, so that the screw member 91 is detached from the magnetic member 80 automatically. Thus, the socket 90 is mounted on and detached from the drive rod 40 easily and conveniently, and the screw member 91 is mounted on and detached from the magnetic member 80 easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket wrench extension, comprising:

an elongated rod, having one end having an inner wall formed with a circular receiving chamber and having a periphery formed with a first locking hole and a second locking hole each communicating with the receiving chamber;

a drive rod, slidably mounted in the receiving chamber of the elongated rod, and having a first end formed with an oblique first retaining cavity communicating with the first locking hole of the elongated rod and an oblique second end formed with a second retaining cavity communicating with the second locking hole of the elongated rod;

a steel ball, mounted in the first retaining cavity of the drive rod, and partially protruded outward from the first locking hole of the elongated rod;

a control knob, mounted in the second retaining cavity of the drive rod, and partially protruded outward from the second locking hole of the elongated rod, wherein when the control knob is pressed, the drive rod is fully retracted into the receiving chamber of the elongated rod;

an elastic member, mounted in the receiving chamber of the elongated rod, and having a first end urged on the second end of the drive rod and a second end urged on the wall of the receiving chamber of the elongated rod;

a magnetic member, secured on the first end of the drive rod; and a control ring mounted on the outer wall of the elongated rod, wherein the control ring has an inner wall formed with an arcuate guide grove aligning with the second locking hole of the elongated rod for receiving the control knob, and wherein the wall of the arcuate groove of the control ring is moved to press the control knob when the control ring rotates.

* * * * *